US008944393B2

(12) United States Patent
Mitsuhashi

(10) Patent No.: US 8,944,393 B2
(45) Date of Patent: Feb. 3, 2015

(54) FIXING STRUCTURE AND FIXING METHOD OF MULTI-SCREEN DISPLAY UNIT

(75) Inventor: Renichi Mitsuhashi, Tokyo (JP)

(73) Assignee: Nec Display Solutions, Ltd., Tokyo (JP)

( * ) Notice: Subject to any disclaimer, the term of this patent is extended or adjusted under 35 U.S.C. 154(b) by 735 days.

(21) Appl. No.: 13/255,440

(22) PCT Filed: Apr. 8, 2009

(86) PCT No.: PCT/JP2009/057230

§ 371 (c)(1),
(2), (4) Date: Sep. 8, 2011

(87) PCT Pub. No.: WO2010/116502

PCT Pub. Date: Oct. 14, 2010

(65) Prior Publication Data

US 2011/0315837 A1 Dec. 29, 2011

(51) Int. Cl.

| | |
|---|---|
| ***A47B 96/06*** | (2006.01) |
| ***G09F 9/00*** | (2006.01) |
| ***G09F 7/18*** | (2006.01) |

(52) U.S. Cl.

CPC .. *G09F 9/00* (2013.01); *G09F 7/18* (2013.01); *Y10S 248/919* (2013.01)

USPC ..... 248/220.22; 248/919; 361/679.04

(58) Field of Classification Search

USPC ..... 248/220.22, 222.41, 298.1, 918, 919; 361/679.04, 679.21, 807

See application file for complete search history.

(56) References Cited

U.S. PATENT DOCUMENTS

| | | | | |
|---|---|---|---|---|
| 5,904,328 | A * | 5/1999 | Leveridge et al. | 248/124.1 |
| 6,138,968 | A * | 10/2000 | Svantesson et al. | 248/222.13 |
| 6,343,006 | B1 * | 1/2002 | Moscovitch et al. | 361/679.04 |
| 6,554,238 | B1 * | 4/2003 | Hibberd | 248/278.1 |
| 8,369,103 | B2 * | 2/2013 | Mitsuhashi | 361/807 |

(Continued)

FOREIGN PATENT DOCUMENTS

| | | | |
|---|---|---|---|
| JP | 4-319993 | A | 11/1992 |
| JP | 10-198286 | A | 7/1998 |
| JP | 2000-242191 | A | 9/2000 |

(Continued)

OTHER PUBLICATIONS

Notice of Allowance dated Nov. 8, 2011, with English translation, in JPA No. 2011-508140.

(Continued)

*Primary Examiner* — Gwendolyn Baxter

(74) *Attorney, Agent, or Firm* — McGinn IP Law Group, PLLC

(57) ABSTRACT

A fixing structure for a multi-screen display unit which forms a large screen by contiguously disposing a plurality of display units with respect to a mounting pedestal by making a first supporting member provided on the back surface of the display unit be engaged with a second supporting member provided at the mounting pedestal, wherein the first supporting member includes a monitor fitting which has a display-side supporting plate provided so as to protrude from the back surface and is disposed at a corner portion of the back surface of the display unit, the second supporting member includes a fixing-side supporting plate which is provided at a position corresponding to the display-side supporting plate to protrude toward the back surface and supports the display-side supporting plate, and a pin member is provided in an upright manner at the fixing-side supporting plate.

19 Claims, 15 Drawing Sheets

(56) References Cited

U.S. PATENT DOCUMENTS

| | | | | |
|---|---|---|---|---|
| 2006/0238967 | A1* | 10/2006 | Carson et al. | 361/681 |
| 2006/0266900 | A1* | 11/2006 | May et al. | 248/220.22 |

FOREIGN PATENT DOCUMENTS

| | | | |
|---|---|---|---|
| JP | 2000-312318 | A | 11/2000 |
| JP | 2001-147646 | A | 5/2001 |
| JP | 2002-215053 | A | 7/2002 |
| JP | 2003-15541 | A | 1/2003 |
| JP | 2004-341468 | A | 12/2004 |
| JP | 3110700 | | 6/2005 |
| JP | 3148195 | | 2/2009 |

OTHER PUBLICATIONS

International Search Report (ISR) (PCT Form PCT/ISA/210) dated May 19, 2009, with English translation.

* cited by examiner

FIXING STRUCTURE AND FIXING METHOD OF MULTI-SCREEN DISPLAY UNIT

TECHNICAL FIELD

The present invention relates to a multi-screen display unit which forms a large screen by contiguously disposing a plurality of display units, and to a technique relating to a fixing structure and a fixing method which allow the plurality of display units to be accurately positioned and fixed.

BACKGROUND ART

As flat-screen monitors, there are liquid crystal display devices, plasma display devices, and the like, and as for the sizes of these devices, up to a 50-inch class is mass-produced. Further, in order to make a large screen exceeding 100 inches, a multi-screen display device which performs display by arranging a plurality of display devices is adopted. For example, if 50-inch display devices are arranged with two vertically and two horizontally, a large screen display device of 100 inches can be constituted.

As a fixture which fixes such a display device, for example, an installation device of a display device disclosed in Japanese Patent Application No. 2001-147646 is known.

The installation device disclosed in Japanese Patent Application No. 2001-147646 has a display section mounting fitting fixed to the rear surface of the display device, a locking member which supports the display section mounting fitting, and a hanging member which hangs the locking member through a cylindrical fitting so as to be able to freely turn, and the display device is fixed and held with respect to the hanging member by the display section mounting fitting, the locking member, and the cylindrical fitting.

DOCUMENTS OF THE PRIOR ART

[Patent Document 1] JP Application No. 2001-147646.

DISCLOSURE OF INVENTION

Problem to be Solved by the Invention

Incidentally, since the installation device of a display device disclosed in Patent Document 1 directly fixes the display section mounting fitting fixed to the rear surface of the display device to the locking member provided at an installation fitting by using a screw, for example, in a case where misalignment has occurred between contiguous display devices, there is a problem in that it is difficult to adjust this.

Further, in the installation device of a display device, since it has a configuration in which the display section mounting fitting fixed to the central portion of the rear surface of the display device is supported by the locking member provided at the installation fitting, alignment of the display section mounting fitting of the display device and the locking member is difficult and this also causes misalignment in a lateral direction or a lengthwise direction between contiguous displace devices as described above.

The present invention has been made in view of such circumstances and has an object to provide a fixing structure and a fixing method for a multi-screen display unit, in which when installing a plurality of display units, it is possible to easily adjust misalignment of the display units, whereby it is possible to accurately position and fix the display units without generating a clearance between contiguous display units.

Means for Solving the Problem

In order to achieve the above object, the invention proposes the following means.

That is, according to an aspect of the invention, there is provided a fixing structure for a multi-screen display unit which forms a large screen by contiguously disposing a plurality of display units with respect to a mounting pedestal by making a first supporting member provided on the back surface of the display unit be engaged with a second supporting member provided at the mounting pedestal, wherein the first supporting member includes a monitor fitting which has a display-side supporting plate provided so as to protrude from the back surface of the display unit and is disposed at a corner portion of the back surface of the display unit, the second supporting member includes a fixing-side supporting plate which is provided at a position corresponding to the display-side supporting plate to protrude toward the back surface of the display unit and supports the display-side supporting plate, a pin member is provided in an upright manner at the fixing-side supporting plate so as to be engaged with the display-side supporting plate and follow the lengthwise direction of the display unit, and the display-side supporting plate and the fixing-side supporting plate relatively move so as to follow the lateral direction of the display unit.

Further, according to another aspect of the invention, there is provided a fixing method for a multi-screen display unit which forms a large screen by contiguously disposing a plurality of display units with respect to a mounting pedestal, the method including: disposing monitor fittings each having a display-side supporting plate provided so as to protrude from the back surface of the display unit, at corner portions of the back surface of the display unit; and adjusting misalignment in the lateral direction of the display unit by adjusting the position of the display-side supporting plate with respect to a fixing-side supporting plate along the lateral direction of the display unit in a state where a pin member provided at the mounting pedestal through the fixing-side supporting plate is engaged with the display-side supporting plate.

Advantageous Effects of the Invention

According to the invention, in a state where the pin member of the fixing-side supporting plate in the second supporting member provided at the mounting pedestal is engaged with the display-side supporting plate of the first supporting member provided at the back surface of the display unit, the display-side supporting plate is supported on the fixing-side supporting plate, and accordingly, the entire display unit is supported on the mounting pedestal. Thus, since a configuration is made in which the display-side supporting plate and the fixing-side supporting plate relatively move so as to follow the lateral direction of the display unit, it is possible to easily adjust misalignment in the lateral direction of the display unit, so that when installing a plurality of display units, it is possible to accurately position and fix the display units without generating a clearance between contiguous display units.

EMBODIMENTS FOR CARRYING OUT THE INVENTION

Hereinafter, embodiments of the invention will be described with reference to the drawings. Each embodiment described below shows one example among the embodiments of the invention, but the invention is not limited to these embodiments.

<First Embodiment>

Figure 1:
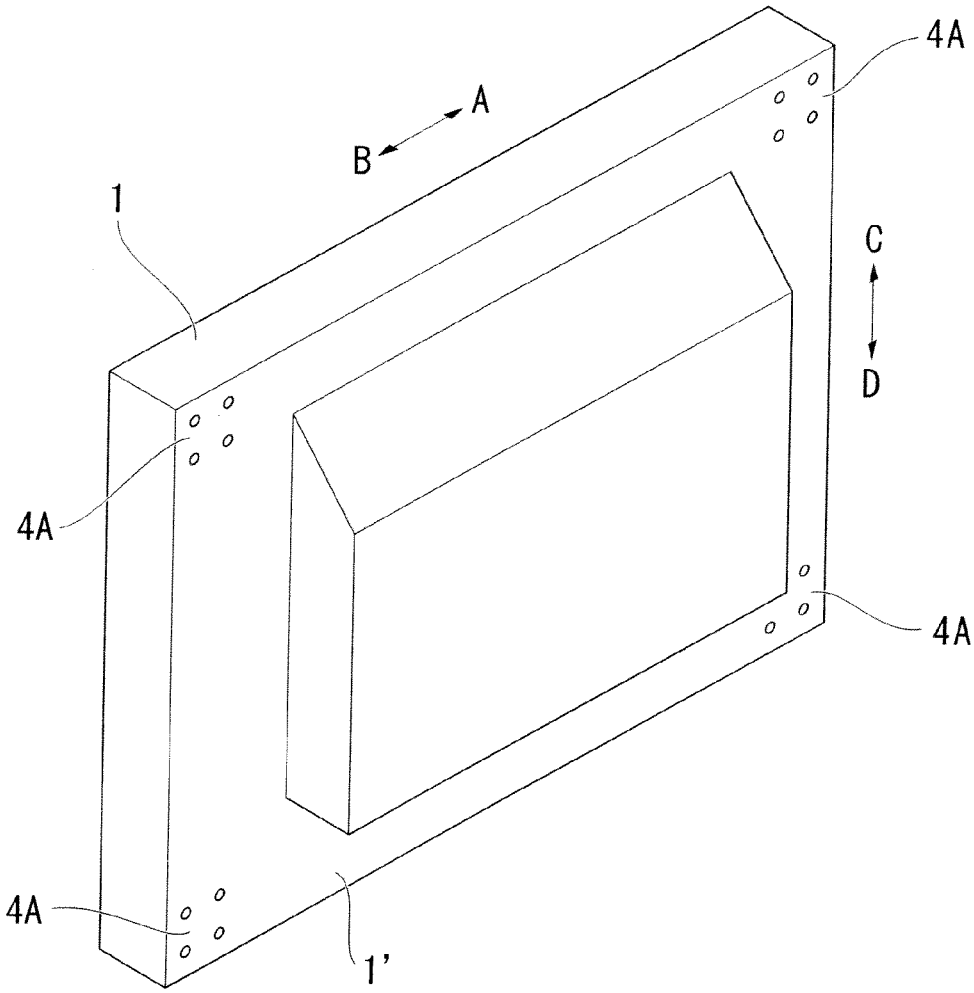
FIG. 1 is a perspective view of a display unit related to a first embodiment of the invention, viewed from the rear side.
Figure 2:
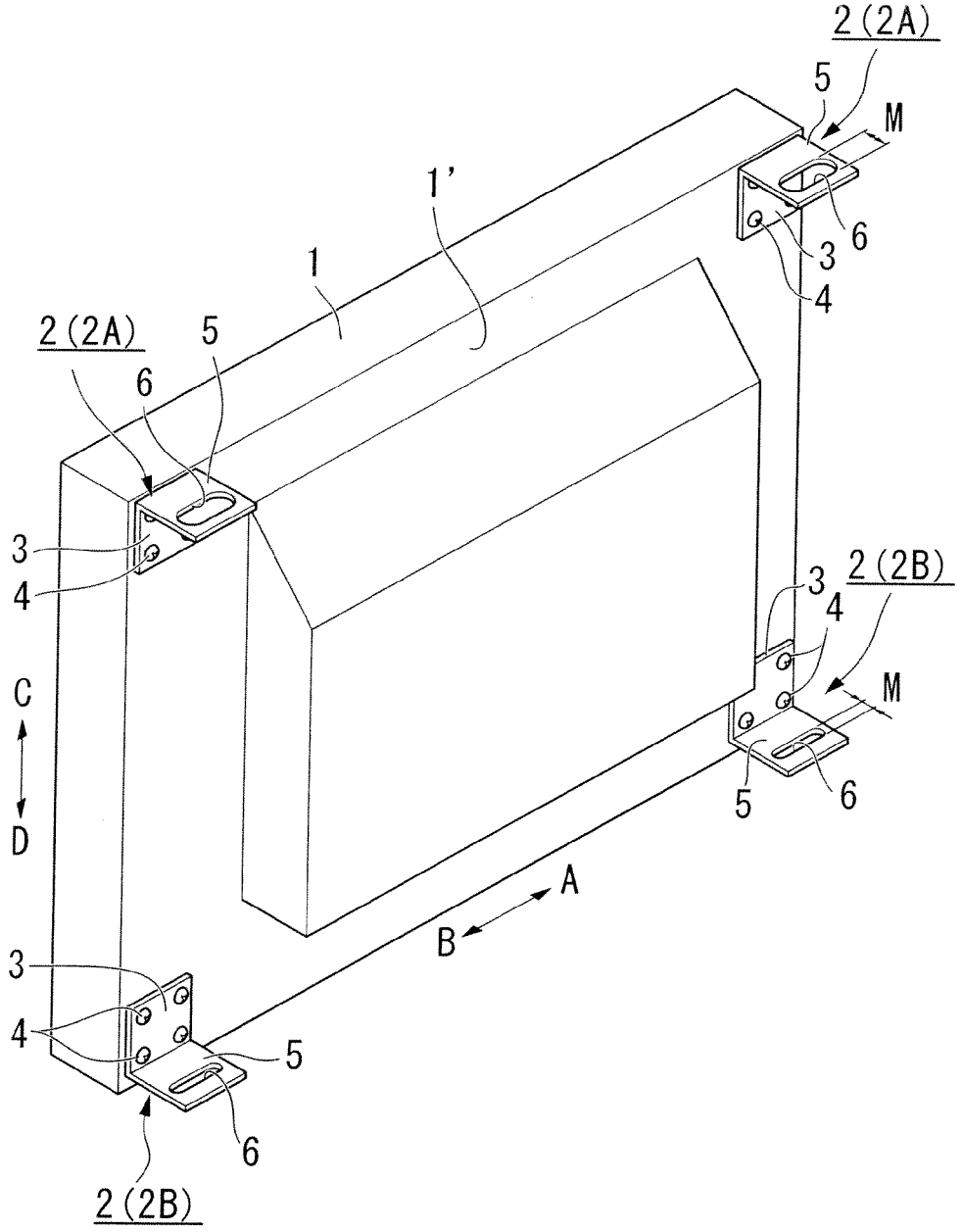
FIG. 2 is a perspective view showing a state where monitor fittings have been mounted on the display unit of FIG. 1.

FIGS. 1 to 7 are diagrams showing a fixing structure and a fixing method for a multi-screen display unit related to the first embodiment of the invention. As shown in FIGS. 1 and 2, monitor fittings 2 (first supporting members) are provided at four corner portions of the back surface (denoted by a symbol 1') of a display unit 1.

The monitor fitting 2 is formed by an L-shaped fitting, and a plate-like body 3 on one side constituting the L-shaped fitting is fixed to a mounting hole 4A of the back surface 1' of the display unit 1 by a screw 4, and a plate-like body 5 (a display-side supporting plate) on the other side constituting the L-shaped fitting is disposed so as to protrude from the back surface 1' of the display unit 1 and form a right angle with respect to the back surface 1' of the display unit 1. In the plate-like body 5 on the other side of the monitor fitting 2, a long hole 6 is formed so as to follow the lateral direction (a direction of an arrow A-B) of the display unit 1.

The long holes 6 of the monitor fittings 2 have width dimensions (denoted by a symbol M) which are different in two sets of monitor fittings 2 (hereinafter referred to as upper monitor fittings 2A) which are located on the upper side, and two sets of monitor fittings 2 (hereinafter referred to as lower monitor fittings 2B) which are located on the lower side.

The width dimension M (refer to FIG. 2) in the upper monitor fitting 2 (2A) is formed so as to be larger than that in the lower monitor fitting 2 (2B). This is due to a difference in the engagement place with a pin member 15 of a bracket 11. That is, the width dimension M of the long hole 6 of the upper monitor fitting 2 (2A) is set such that the long hole 6 of the upper monitor fitting 2 (2A) is engaged with a base end portion 16 of the pin member 15, and the width dimension M of the long hole 6 of the lower monitor fitting 2 (2B) is set such that the long hole 6 of the lower monitor fitting 2 (2B) is engaged with a support pin 17 of the pin member 15 (this will be described later).

Figure 3:
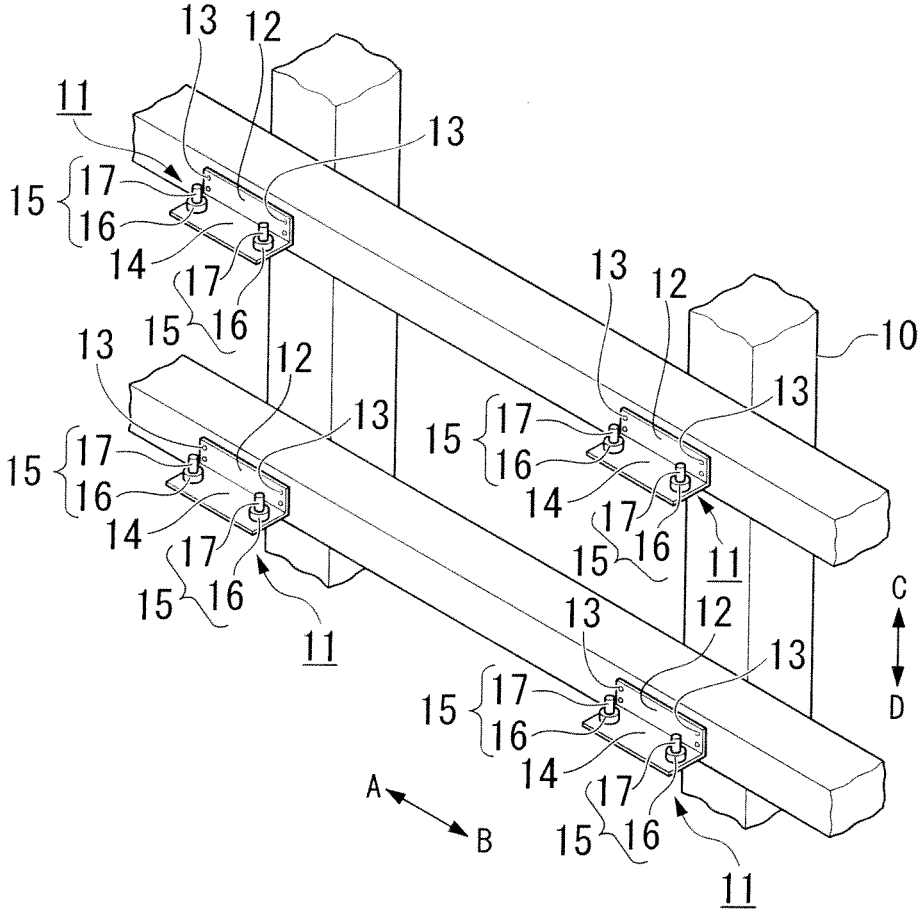
FIG. 3 is a perspective view showing a frame, on which the display unit of FIG. 1 is mounted.

As shown in FIG. 3, a plurality of brackets 11 (second supporting members) which are connected to the above-described monitor fittings 2 are fixed to a frame 10 (a mounting pedestal), on which the display unit 1 is mounted. The bracket 11 is formed by an L-shaped fitting, similarly to the monitor fitting 2, and a plate-like body 12 on one side constituting the L-shaped fitting is fixed to the frame 10 by screws 13, and a plate-like body 14 (a fixing-side supporting plate) on the other side constituting the L-shaped fitting is disposed so as to protrude from the frame 10 and form a right angle with the frame 10. Specifically, the plate-like body 14 of the bracket 11 is provided at a position corresponding to the plate-like body 5 of the monitor fitting 2, and also formed to protrude toward the back surface 1' of the display unit 1.

Further, each of the plurality of brackets 11 which are fixed to the frame 10 is made to have a pair of pin members 15 provided so as to be spaced from each other on the plate-like body 14, and each pin member 15 is constituted by the large-diameter base end portion 16 provided on the plate-like body 14 of the bracket 11 and the small-diameter support pin 17 provided in an upright manner in a lengthwise direction direction of an arrow C-D) on the base end portion 16, as shown in FIG. 3.

Figure 4:
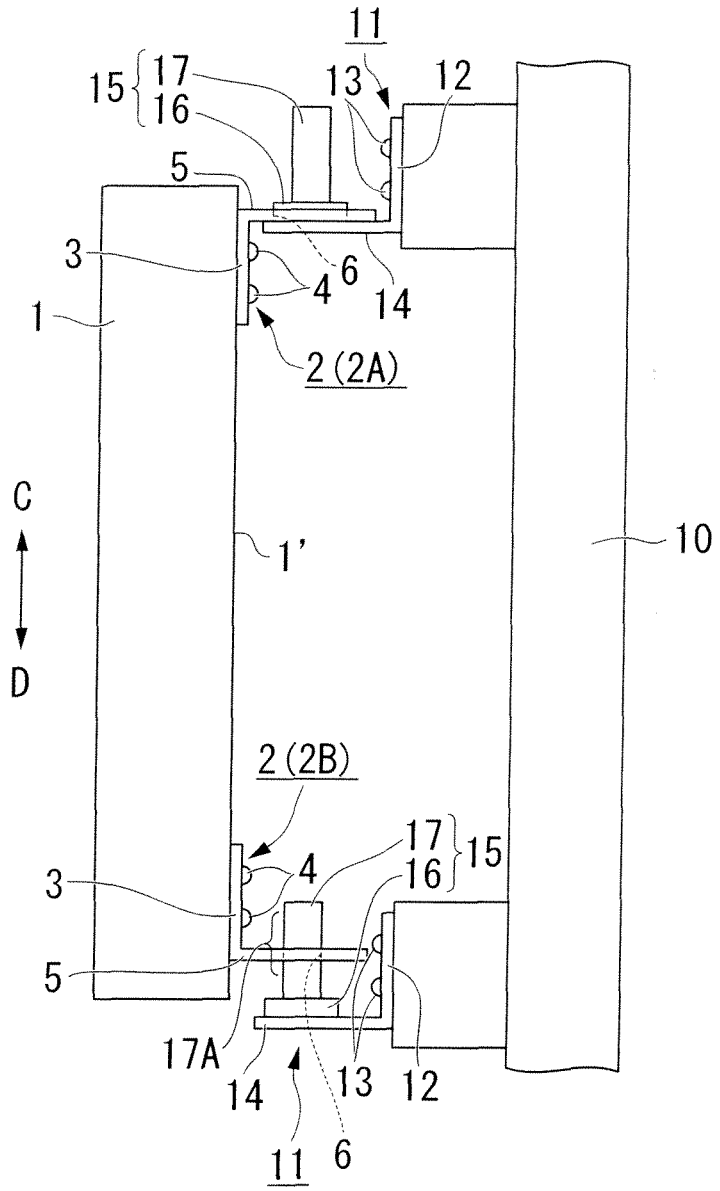
FIG. 4 is a side view showing a state where the display unit of FIG. 1 has been mounted on the frame.

As shown in FIG. 4, the base end portion 16 of the pin member 15 has a diameter set such that the base end portion 16 is engaged with the long hole 6 of the upper monitor fitting 2 (2A), and the support pin 17 of the pin member 15 has a diameter set such that the support pin 17 is engaged with the long hole 6 of the lower monitor fitting 2 (2B). Further, in a case where the pin members 15 of the brackets 11 have been inserted into the long holes 6 of the upper and lower monitor fittings 2, as shown in FIG. 4, the positional relationship in the lengthwise direction (the direction of the arrow C-D) between the monitor fitting 2 and the bracket 11 is set such that the plate-like body 5 of the upper monitor fitting 2 (2A) is supported by the plate-like body 14 of the bracket 11 fixed to the frame 10.

Thus, due to this dimensional setting, in a case where the monitor fittings 2 have been engaged with the brackets 11, in a state where the long hole 6 of the upper monitor fitting 2 (2A) is engaged with the base end portion 16 of the pin member 15, as shown in FIG. 4, the plate-like body 5 of the upper monitor fitting 2 (2A) is supported on the plate-like body 14 of the bracket 11, and also the long hole 6 of the lower monitor fitting 2 (2B) is disposed at an intermediate portion (denoted by a symbol 17A in FIG. 4) along the length direction of the support pin 17.

Figure 5:
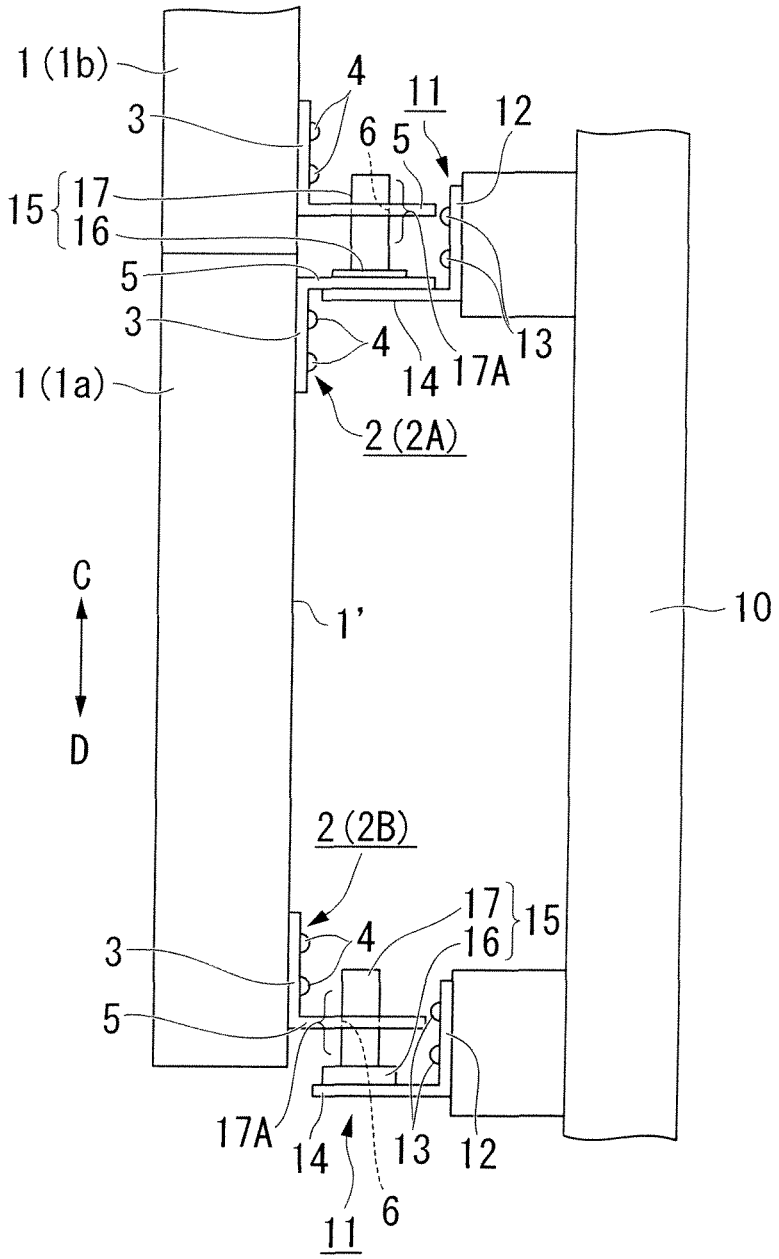
FIG. 5 is a side view showing a state where the display unit of FIG. 1 has been mounted in plural stages in a lengthwise direction on the frame.

Thus, due to the disposition of the monitor fittings 2 on the brackets 11, an upper portion of the support pin 17 of the bracket 11, which is inserted into the long hole 6 of the upper monitor fitting 2 (2A), is in an idle state, so that it is possible to make another display unit 1 be engaged with the support pin 17. That is, as shown in FIG. 5, if installation is achieved with the aid of the support pin 17 such that another display unit 1 (denoted by a symbol 1*b* in FIG. 5) is located on the upper side of the first installed display unit 1 (denoted by a symbol 1*a* in FIG. 5), and the long hole 6 of the lower monitor fitting 2 (2B) constituting the monitor fitting 2 of the display unit 1 (1*b*) is located at the intermediate portion 17A along the length direction of the support pin 17, it becomes possible to use the bracket 11 in common in at least two upper and lower display units 1 (1*a* and 1*b*).

Figure 6:
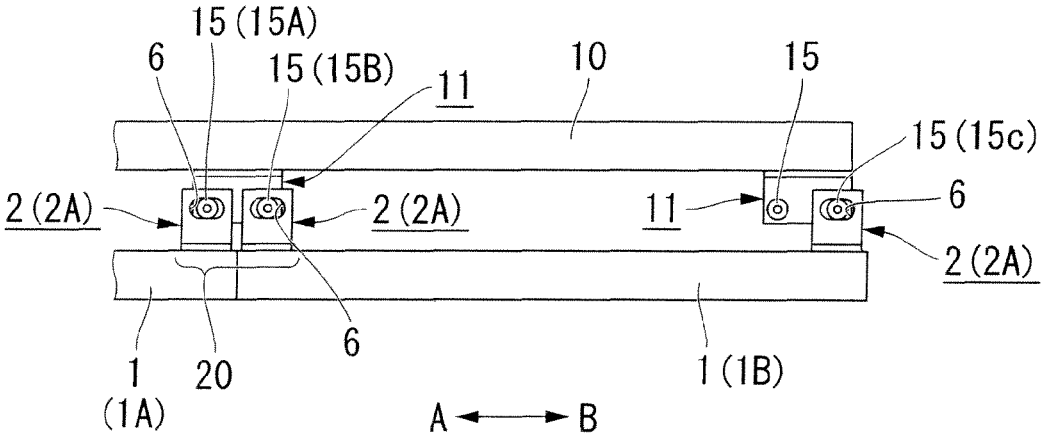
FIG. 6 is a plan view showing a state where the display unit of FIG. 1 has been mounted in a plurality in a lateral direction on the frame.

On the other hand, the pin members 15 of each bracket 11 are located on the plate-like body 14 of the bracket 11 to correspond to the interval between the long holes 6 of a pair of monitor fittings 2 installed in the lateral direction (the direction of the arrow A-B) at the display units 1. Specifically, as shown in FIG. 6, in a case where at least two display units 1 are disposed contiguously in the lateral direction (the direction of the arrow A-B), the pin member 15 (denoted by a symbol 15A) on one side can be inserted into the long hole 6 of the monitor fitting 2 provided at the display unit 1 (denoted by a symbol 1A) on one side and the pin member 15 (denoted by a symbol 15B) on the other side can be inserted into the long hole 6 of the monitor fitting 2 provided at the display unit 1 (denoted by a symbol 1B) on the other side. In this way, at least two display units 1 are connected and disposed in the lateral direction (the direction of the arrow A-B).

In addition, the disposition as shown in FIG. 6 is achieved when making the monitor fittings 2 which are located at adjacent places (a symbol 20) of two display units 1 (1A and 1B) be engaged with one bracket 11. However, with respect to the monitor fitting 2 which is present on the opposite side (the right side in FIG. 6) to the adjacent places 20, the pin member 15 (denoted by a symbol 15C) which is located on the end portion side (in FIG. 6, the arrow B side) of the corresponding bracket 11 is inserted into the long hole 6 of the monitor fitting 2. Thus, due to this disposition of the monitor fitting 2 on the bracket 11, the bracket 11 does not protrude from the display unit 1, so that the attractiveness of the display unit 1 is maintained when viewed from the front.

Further, FIG. 6 is an example in a case where two display units 1 (1A and 1B) are contiguously disposed. However, the number of display units is not particularly limited. In a case where the number of display units which are contiguously disposed is set to be three or more, the positional relationship between two monitor fittings 2 which are located at the adjacent places 20 and the bracket 11 corresponding thereto is set to be the same as that in the two monitor fittings 2 shown in FIG. 6 and the bracket 11 (the pin members 15A and 15B) corresponding thereto. At this time, the number of used brackets 11 in a case where the display units 1 are disposed side by side along the direction of the arrow A-B becomes "the number of display units 1×2+2".

As described in detail above, in the multi-screen display unit shown in this embodiment, after the pin member 15 of the bracket 11 provided at the frame 10 is inserted into the long hole 6 of the monitor fitting 2 provided on the back surface 1' of the display unit 1, by supporting the plate-like body 5 of the monitor fitting 2 by the plate-like body 14 of the bracket 11, the entire display unit 1 is supported on the frame 10. At this time, by inserting the pin member 15 of the bracket 11 provided at the frame 10 into the long hole 6 of the monitor fitting 2 provided on the back surface 1' of the display unit 1 and adjusting the position of the pin member 15 with respect to the long hole 6 along the length direction of the long hole 6, it is possible to easily adjust misalignment in the lateral direction (the direction of the arrow A-B) of the display unit 1, and accordingly, when installing a plurality of display units 1, it becomes possible to accurately position and fix the display unit 1 without generating a clearance between contiguous display units 1.

Further, in the multi-screen display unit of this embodiment, the pin member 15 of the bracket 11 is constituted by the large-diameter base end portion 16 provided on the plate-like body 14 of the bracket 11 and the small-diameter support pin 17 provided in an upright manner in the lengthwise direction (the direction of the arrow C-D) on the base end portion 16, and in a case where the monitor fittings 2 have been engaged with the brackets 11, the long hole 6 of the upper monitor fitting 2 (2A) is engaged with the base end portion 16 of the pin member 15 and also the plate-like body 5 of the upper monitor fitting 2 (2A) is supported on the plate-like body 14 of the bracket 11, and the long hole 6 of the lower monitor fitting 2 (2B) is disposed at the intermediate portion 17A along the length direction of the support pin 17 of the pin member 15. Thus, due to this configuration, the upper portion of the support pin 17 of the bracket 11, which is inserted into the long hole 6 of the upper monitor fitting 2 (2A), is in an idle state, so that it is possible to make another display unit 1 be engaged with the support pin 17. That is, if installation is achieved with the aid of the support pin 17 such that another display unit 1 (1*b*) is located on the upper side of the first installed display unit 1 (1*a*) (refer to FIG. 5), it becomes possible to use the bracket 11 in common in at least two upper and lower display units 1, so that it becomes possible to support a plurality of display units 1 by using a small number of brackets 11.

Further, in the multi-screen display unit of this embodiment, in a case where at least two display units 1 (1A and 1B) are disposed contiguously in the lateral direction (the direction of the arrow A-B) (refer to FIG. 6), installation is achieved such that the pin member 15 on one side of the bracket 11 is inserted into the long hole 6 of the monitor fitting 2 provided at the display unit 1 (1A) on one side and the pin member 15 on the other side of the bracket 11 is inserted into the long hole 6 of the monitor fitting 2 provided at the display unit 1 (1B) on the other side. In this way, in at least two display units 1 (1A and 1B) which are disposed contiguous to each other, it is possible to support adjacent monitor fittings 2 of the respective display units 1 by any one of a pair of pin members 15 provided at the plate-like body 14 of the same bracket 11, and accordingly, it becomes possible to use the bracket 11 in common in at least two laterally-disposed display units 1, so that it becomes possible to support a plurality of display units 1 by using a small number of brackets 11.

Figure 7:
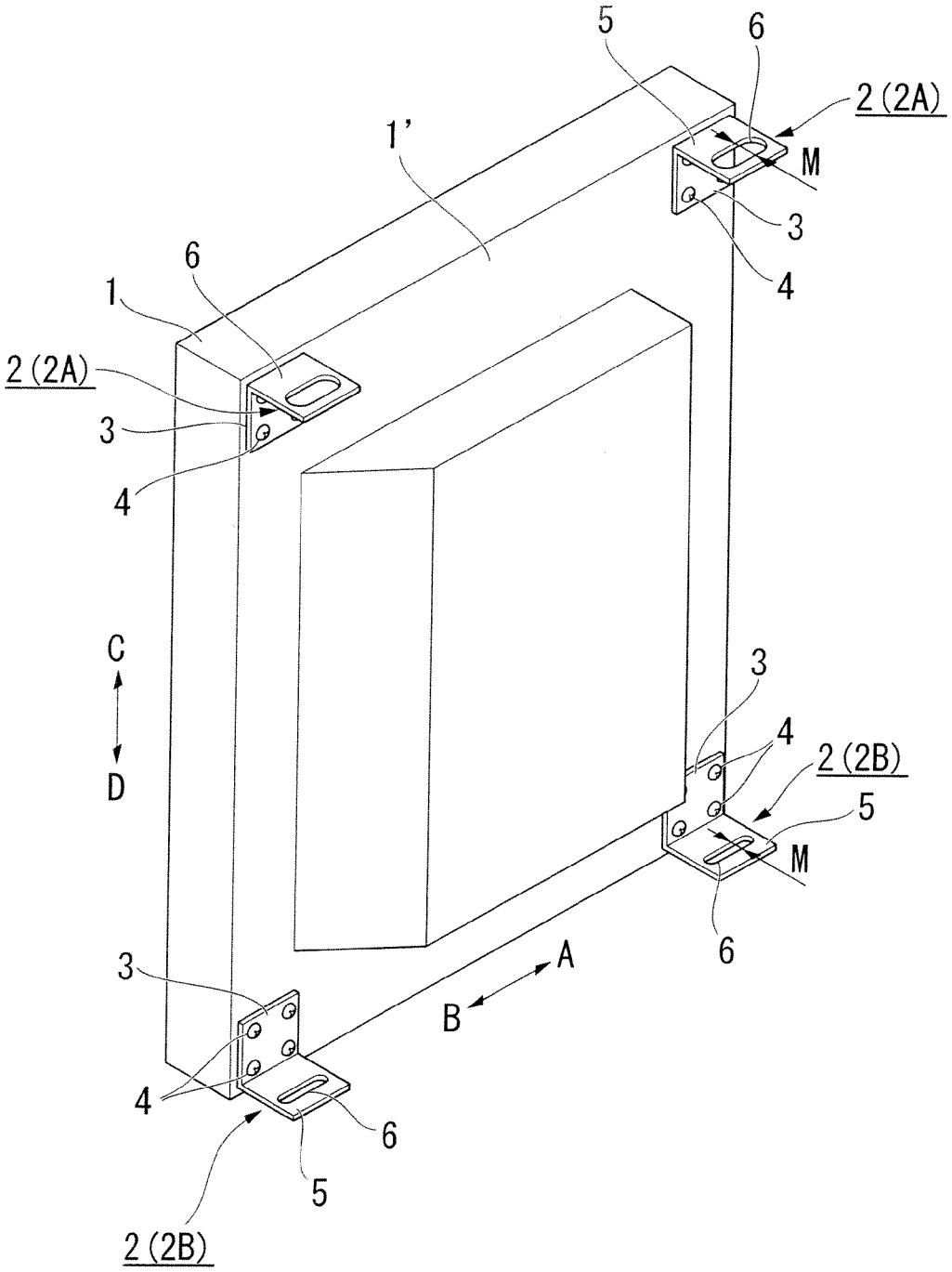
FIG. 7 is a perspective view showing a state where the monitor fittings for making the display unit of FIG. 1 a vertical type have been mounted.

In addition, in this embodiment, the monitor fittings 2 are fixed to the back surface 1' of the display unit 1 such that the display unit 1 lies sideways. However, it is not limited thereto and as shown in FIG. 7, the monitor fittings 2 may also be fixed to the back surface 1' of the display unit 1 such that the display unit 1 becomes a vertical type. Further, in FIG. 5, an example in a case where a plurality of display units 1 are disposed contiguously in the lengthwise direction (the direction of the arrow C-D) is shown, and in FIG. 6, an example in a case where a plurality of display units 1 are disposed contiguously in the lateral direction (the direction of the arrow A-B) is shown. However, it goes without saying that a plurality of display units 1 can be disposed in a matrix form by the combination of the above. In this case, the number of used brackets 11 needed in the case of constituting the display units 1 of L columns horizontally and R stages vertically becomes "(L+1)×(R+1)".

Figure 8:
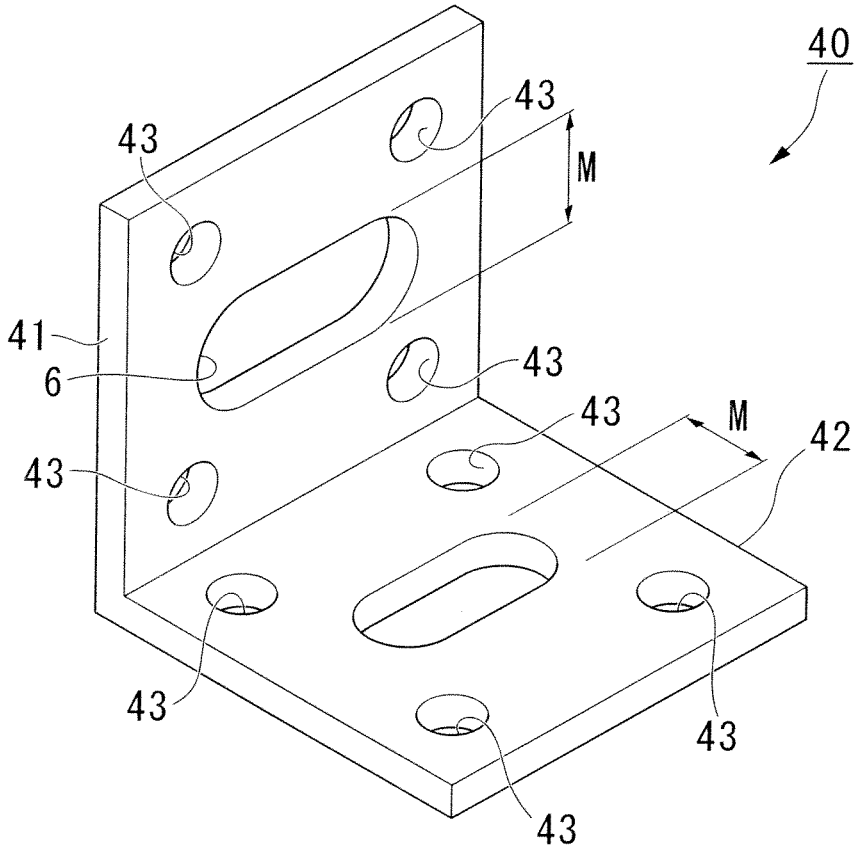
FIG. 8 is a perspective view showing an L-shaped fitting related to another embodiment of the invention, which is used as the monitor fitting.

Further, an L-shaped fitting 40 shown in FIG. 8 may also be used as the monitor fitting 2 described above. In the L-shaped fitting 40, a large-diameter long hole 6 having the width dimension M set such that the long hole 6 is engaged with the base end portion 16 of the pin member 15 is formed in a plate-like body 41 on one side, and a small-diameter long hole 6 having the width dimension M set such that the long hole 6 is engaged with the support pin 17 of the pin member 15 is formed in a plate-like body 42 on the other side. In addition, in FIG. 8, a symbol 43 denotes a threaded hole, into which the screw 4 for fixing the L-shaped fitting 40 to the back surface 1' of the display unit 1 is inserted.

Figure 9:
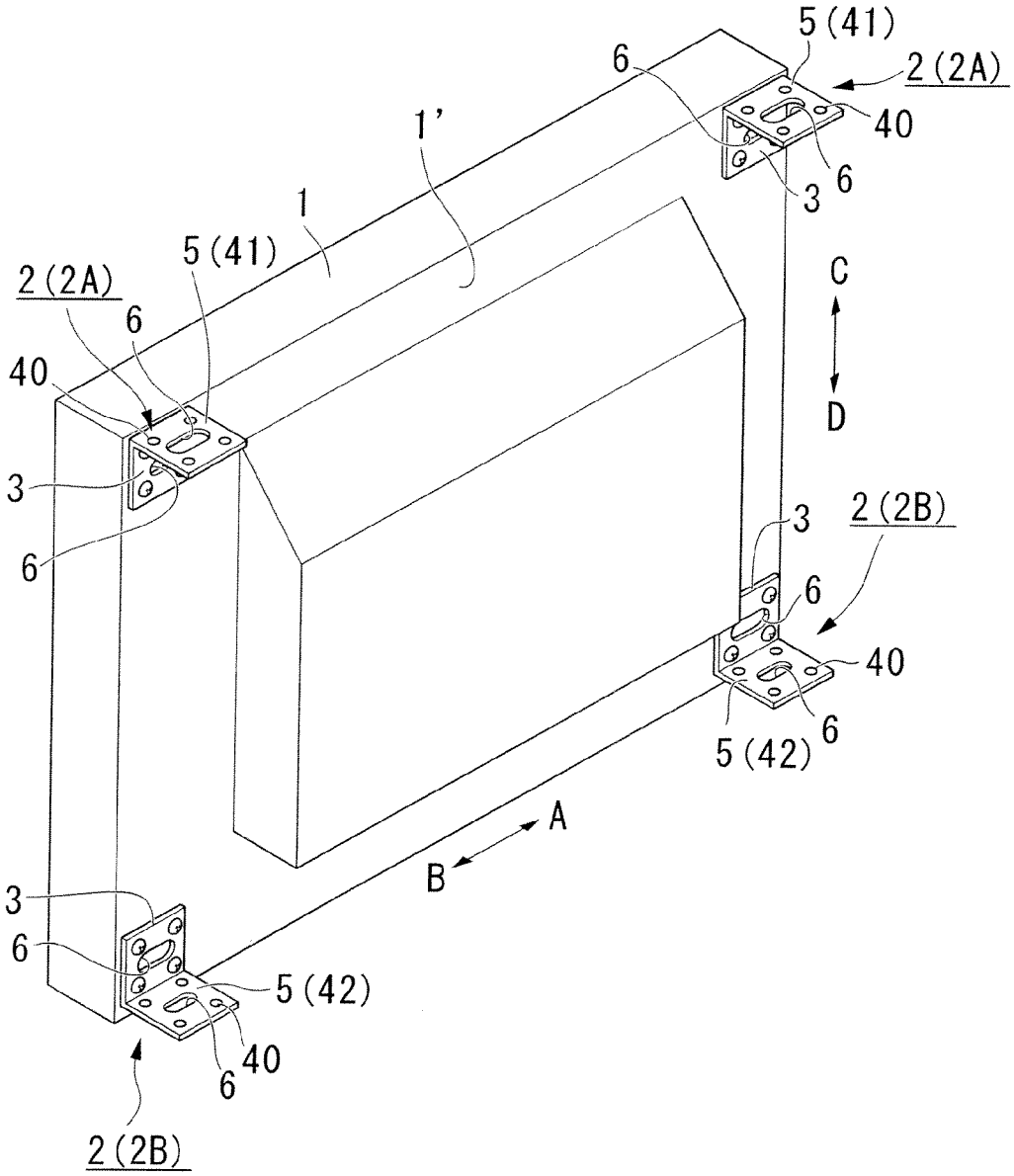
FIG. 9 is a perspective view showing a state where the L-shaped fittings of FIG. 8 have been mounted on the display unit.

Thus, in such an L-shaped fitting 40, as shown in FIG. 9, the upper monitor fitting 2 (2A) can be constituted by fixing the plate-like body 42 having the small-diameter long hole 6 to the back surface 1' of the display unit 1 and causing the plate-like body 41 having the large-diameter long hole 6 to protrude from the back surface 1' of the display unit 1. In this case, the plate-like body 41 of the L-shaped fitting 40 becomes the plate-like body 5 of the upper monitor fitting 2 (2A).

Further, the lower monitor fitting 2 (2B) can be constituted by changing the mounting direction, that is, by fixing the plate-like body 41 having the large-diameter long hole 6 to the back surface 1' of the display unit 1 and protruding the plate-like body 42 having the small-diameter long hole 6 from the back surface 1' of the display unit 1. In this case, the plate-like body 42 of the L-shaped fitting 40 becomes the plate-like body 5 of the lower monitor fitting 2 (2B).

Thus, in such a multi-screen display unit shown in FIG. 9, it is possible to constitute the monitor fitting 2 by the L-shaped fitting 40, set the plate-like body 41 on one side of the L-shaped fitting 40 to be the plate-like body 5 of the upper monitor fitting 2 (2A) having the large-diameter long hole 6, and set the plate-like body 42 on the other side of the L-shaped fitting 40 to be the plate-like body 5 of the lower monitor fitting 2 (2B) having the small-diameter long hole 6. In this way, it is possible to use the L-shaped fitting 40 as either the upper monitor fitting 2 (2A) or the lower monitor fitting 2 (2B) depending on the direction in which it is mounted on the back surface 1' of the display unit 1, and as a result, it is possible to commonalize a part so that it is possible to keep the overall production costs low.

<Second Embodiment>

Figure 10:
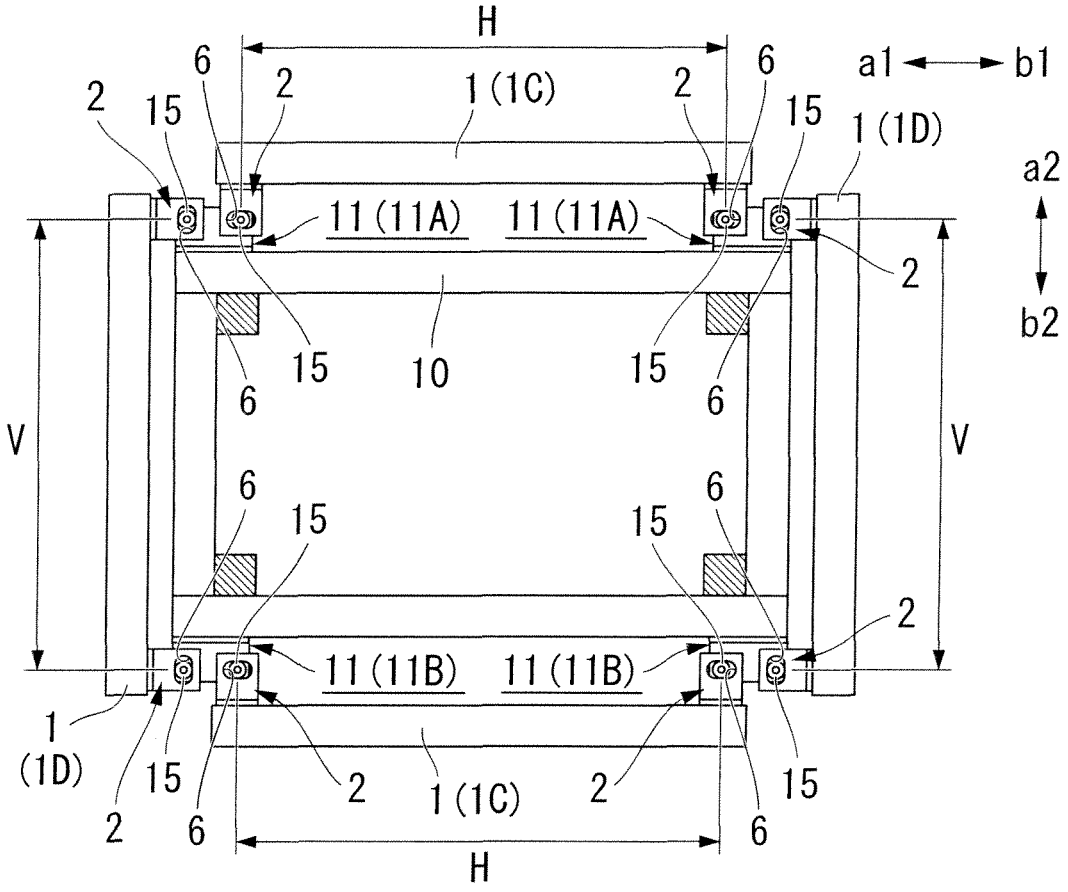
FIG. 10 is a plan view related to a second embodiment of the invention and showing a state where a plurality of display units have been connected to each other so as to form a quadrangle in a plan view.

FIG. 10 is a top view of a multi-screen display unit related to the second embodiment of the invention. The difference between the multi-screen display unit shown in the second embodiment and that in the first embodiment is in the form of disposition in which a plurality of display units 1 (1C and 1D) are disposed so as to form a square shape in the case of a plan view viewed from above.

Specifically, the bracket 11, into which the long hole 6 of the monitor fitting 2 is inserted, is constituted by providing a pair of pin members 15 on the plate-like body 14. However, in this embodiment, as a pair of upper and lower brackets 11, two sets of brackets 11 (the brackets are denoted by symbols 11A and 11A) are disposed at the frame 10 to correspond to the installation interval of the monitor fittings 2 in the display unit 1 and another two sets of the same brackets 11 (the brackets are denoted by symbols 11B and 11B) are additionally disposed at the frame 10 to correspond to the installation interval of the monitor fittings 2 in the display unit 1, so as to be parallel to the previous brackets 11A and 11A. In addition, in this case, a pair of upper and lower brackets 11 as shown in FIGS. 4 and 5 of the previous embodiment is set to be one set and therefore, in two sets, a total of four brackets 11 are used.

Thus, in such brackets 11, the installation intervals (denoted by a symbol H) of the medially-located pin members 15 of the brackets 11A and 11A and the medially-located pin members 15 of the brackets 11B and 11B are set in a horizontal direction (a direction of an arrow a1-b1) to correspond to the installation interval of the long holes 6 of the monitor fittings 2 which support the display unit 1 (denoted by a symbol 1C), and the installation intervals (denoted by a symbol V) of the laterally-located pin members 15 of the brackets 11A and 11A and the laterally-located pin members 15 of the brackets 11B and 11B are set corresponding to the installation interval of the long holes 6 of the monitor fittings 2 which support the display unit 1 (denoted by a symbol 1D), so as to follow a horizontal direction (a direction of an arrow a2-b2) perpendicular to the previous direction of the arrow a1-b1.

That is, four sets of brackets 11A, 11A, 11B, and 11B (a total of eight brackets) are disposed such that four display units 1 (1C and 1D) form a square in a plan view with respect to the frame 10, whereby four display units 1 (1C and 1D) which are mounted on the brackets 11A, 11A, 11B, and 11B through the monitor fittings 2 can be disposed so as to form a square in a plan view.

As described in detail above, in the multi-screen display unit shown in this embodiment, in at least a plurality of display units 1 which are disposed contiguous to each other, by making the monitor fitting 2 of each display unit 1 be supported by any one of a pair of pin members 15 provided at the plate-like body 14 of the same bracket 11, the display units 1 can be disposed so as to form a square in a plan view, such as having a 90°-bend shown in FIG. 10, for example, so that the free layout of a plurality of display units 1 becomes possible.

In addition, in this embodiment, an example in which four display units 1 (1C and 1D) are disposed so as to form a square in a plan view has been given. However, it is not limited thereto and it is acceptable if four or more of the display units 1 are laid out while freely arranged. For example, free layout of a plurality of the display units 1, such as a parallelogram in a plan view, is possible. Further, by using the disposition form shown in FIG. 5 together, the disposition shown in FIG. 10 may also be stacked in plural stages in the lengthwise direction.

<Third Embodiment>

Figure 11:
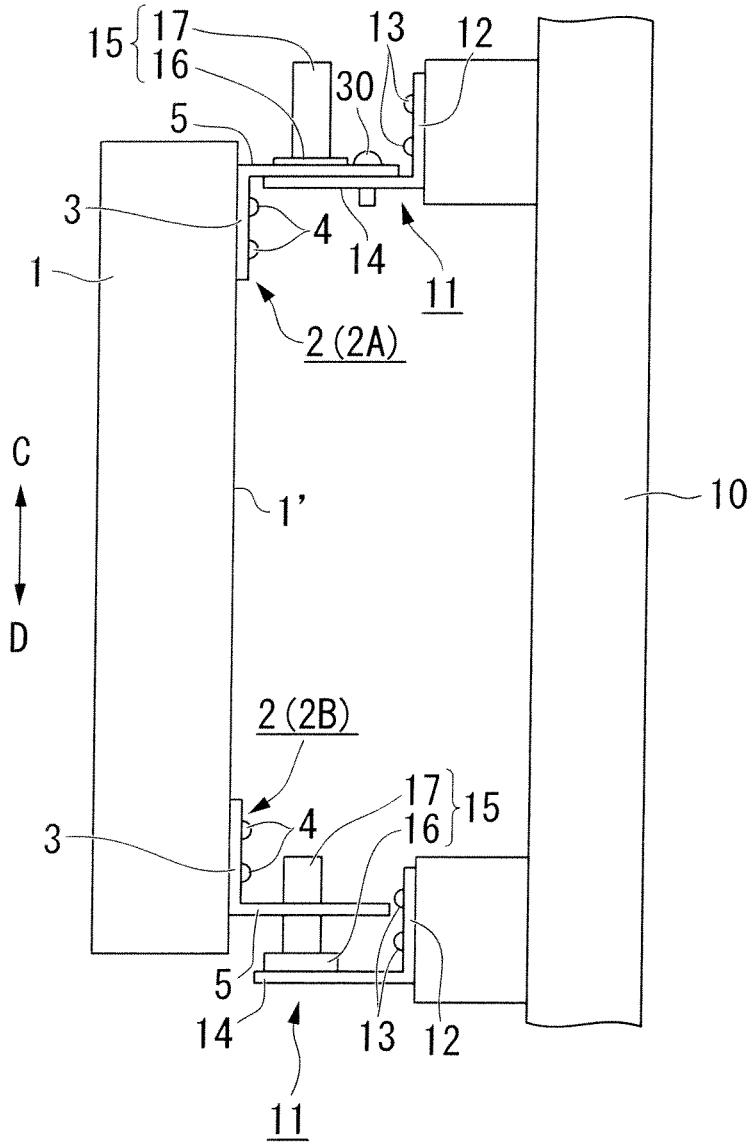
FIG. 11 is a side view related to a third embodiment of the invention and showing a state where the display unit has been fixed to the frame by a screw.
Figure 12:
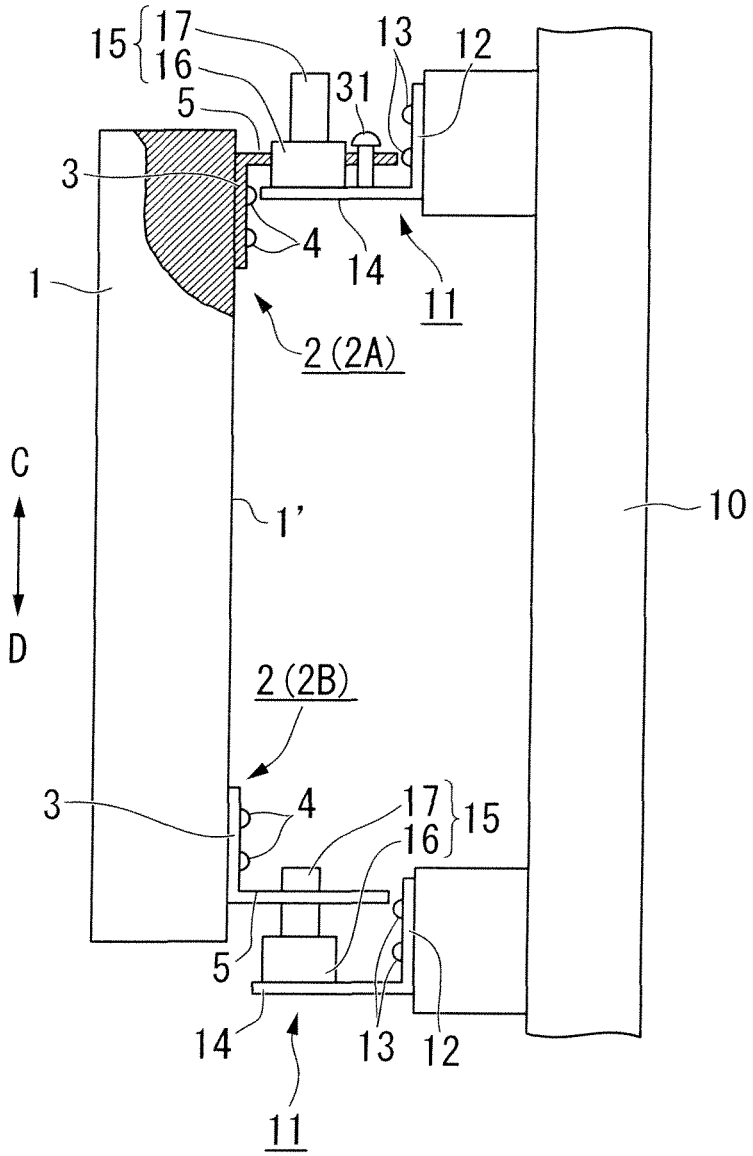
FIG. 12 is a side view showing another form of FIG. 11.

FIGS. 11 and 12 are side views of a multi-screen display unit related to the third embodiment of the invention. The multi-screen display unit shown in the third embodiment is different from the previous embodiments in that screws 30 and 31 connecting the monitor fitting 2 and the bracket 11 are provided.

Specifically, as shown in FIG. 11, in a state where the pin member 15 of the bracket 11 has been inserted into the long hole 6 formed in the plate-like body 5 of the monitor fitting 2, the screw 30 fastening the plate-like bodies 5 and 14 to each other is provided in the plate-like body 5 of the monitor fitting 2 and the plate-like body 14 of the bracket 11. Thus, by thread-engaging such a screw 30 with the plate-like bodies 5 and 14, the display unit 1 can be fixed to and held by the frame 10, so that a problem in which the display unit 1 drops out of the frame 10 can be prevented from occurring.

Further, the fixing and holding of the display unit 1 to the frame 10 is not limited to fixing and holding by the screw 30, and as shown in the partial cross-sectional view of FIG. 12, it is preferable that a screw denoted by a symbol 31 be fastened to the plate-like body 5 of the monitor fitting 2, and the plate-like body 14 of the bracket 11 be pressed by a lower end portion of the screw 31.

Thus, due to this configuration, by appropriately adjusting the screwing position of the screw 31 with respect to the plate-like body 5 of the monitor fitting 2, it is possible to adjust the vertical position of the display unit 1, and accordingly, it becomes possible to accurately position and fix the display unit also in the lengthwise direction thereof without generating a clearance between the display units 1 which are contiguously disposed up and down.

<Fourth Embodiment>

Figure 13:
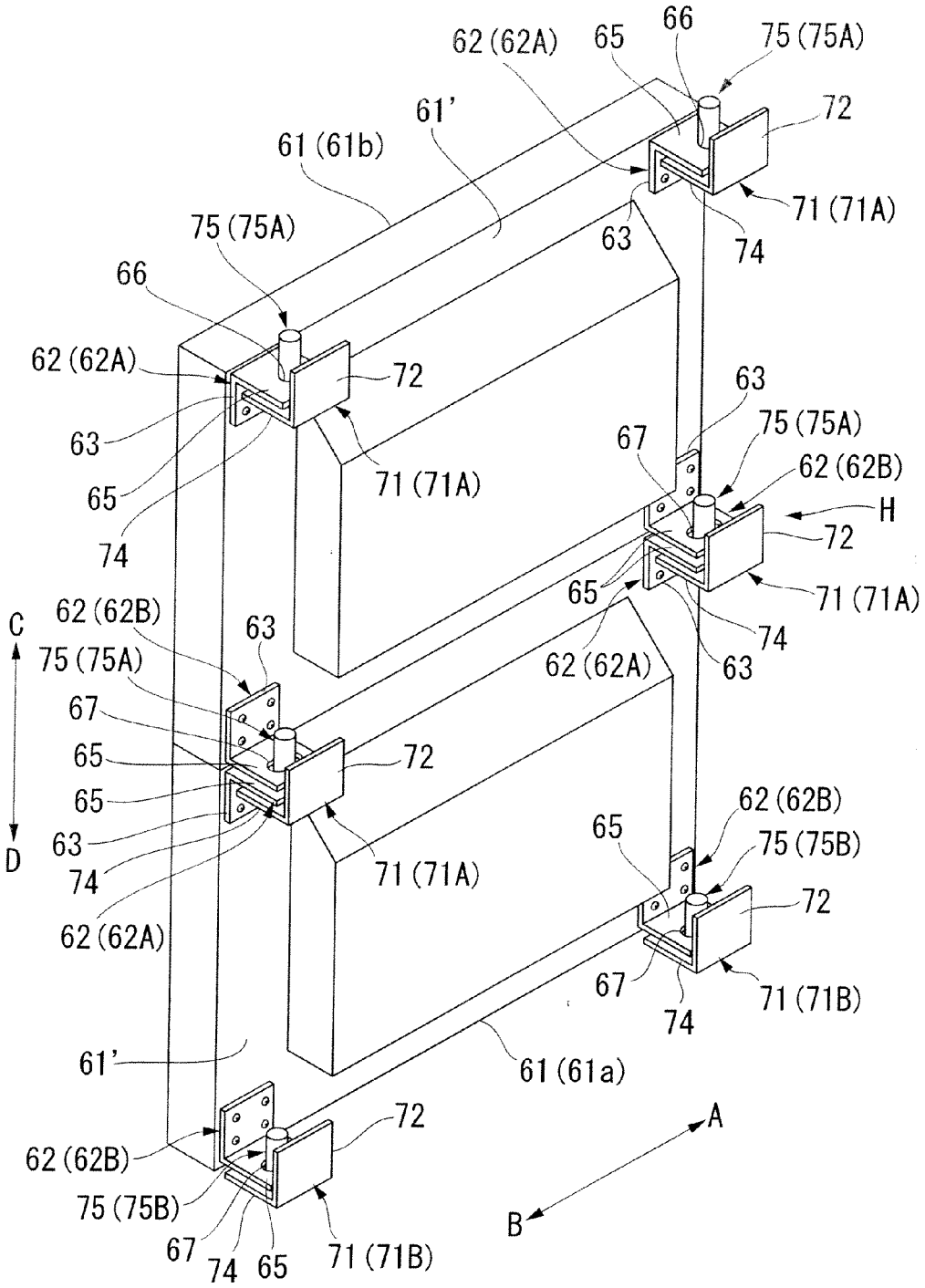
FIG. 13 is a perspective view related to a fourth embodiment of the invention and showing a state where the display unit has been mounted in plural stages in a lengthwise direction on the frame, viewed from the rear side.
Figure 14:
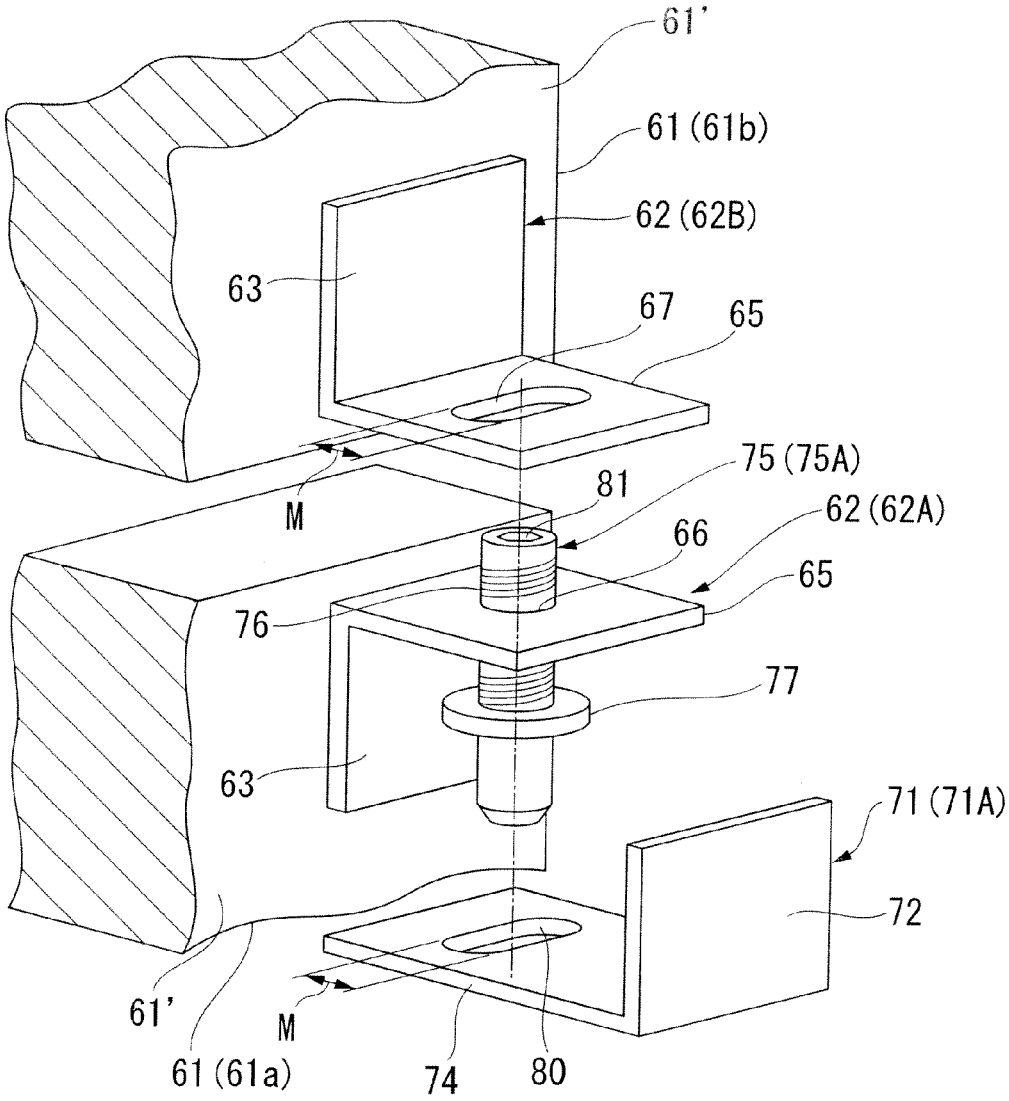
FIG. 14 is an enlarged exploded perspective view showing a portion indicated by an arrow H in FIG. 13.
Figure 15:
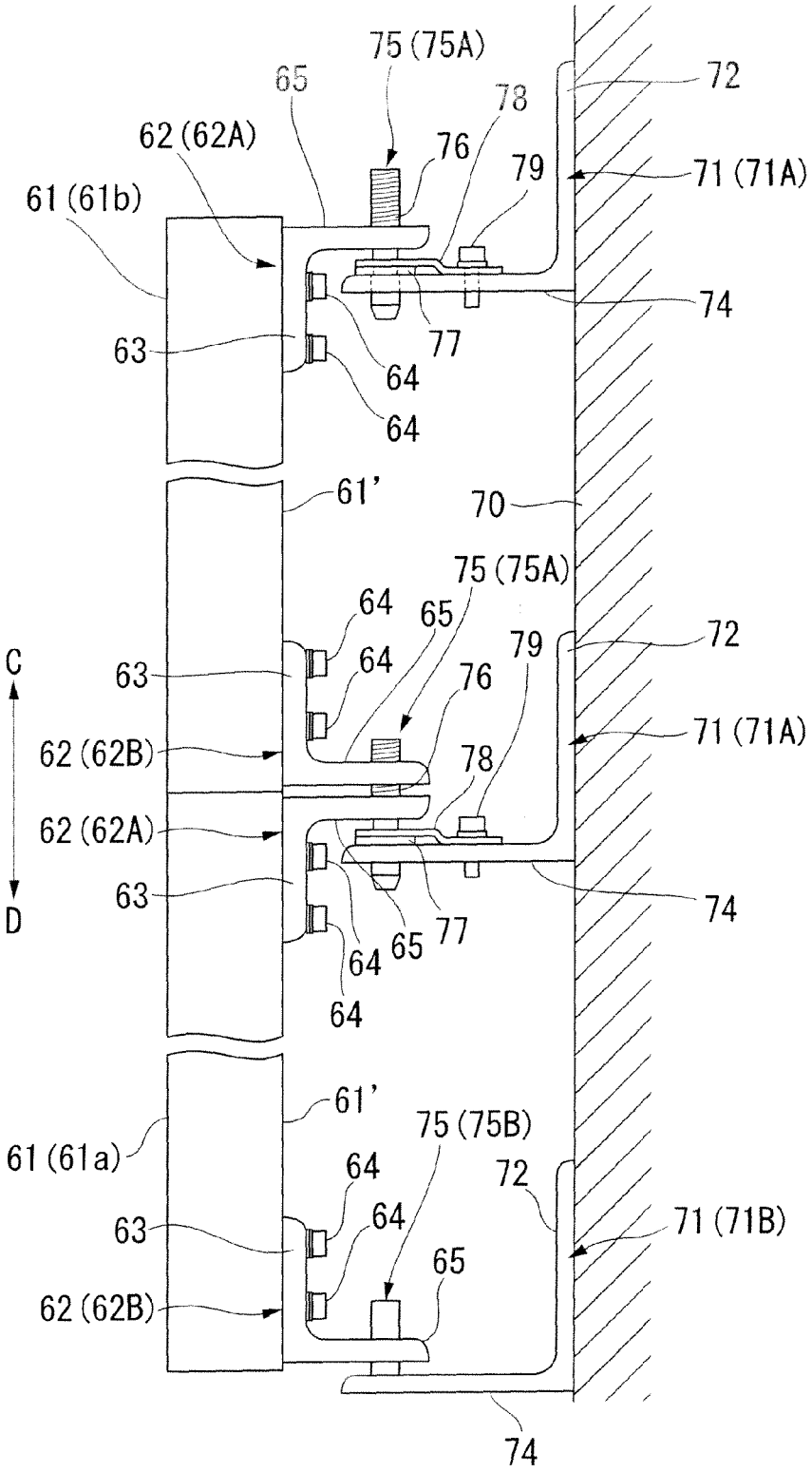
FIG. 15 is a side view in FIG. 13.

FIG. 13 is a perspective view of a multi-screen display unit related to the fourth embodiment of the invention, viewed from the rear side, FIG. 14 is an enlarged exploded perspective view showing a portion indicated by an arrow H in FIG. 13, and FIG. 15 is a side view of FIG. 13. The difference between the multi-screen display unit shown in the fourth embodiment and those in the previous embodiments is in the configuration of making the monitor fitting, the pin member, and the bracket be engaged with each other.

As shown in FIGS. 13 to 15, in this embodiment, two display units 61*a* and 61*b* are used as a display unit 61, and these display units 61*a* and 61*b* are longitudinally stacked, thereby constituting the multi-screen display unit. Further, monitor fittings 62 (the first supporting members) are respectively provided at four corner portions of the back surface (denoted by a symbol 61') of the display unit 61.

The monitor fitting 62 is formed by an L-shaped fitting, and a plate-like body 63 on one side constituting the L-shaped fitting is fixed to a mounting hole (not shown) of the back surface 61' of the display unit 61 by a screw 64 and a plate-like body 65 (the display-side supporting plate) on the other side constituting the L-shaped fitting is disposed so as to protrude from the back surface 61' of the display unit 61 and form a right angle with the back surface 61' of the display unit 61.

Further, specifically, the monitor fitting 62 is constituted by a pair of upper monitor fittings 62A disposed at the upper corner portions of the back surface of the display unit 61, each having a threaded hole 66 formed by providing a female screw threading on the inner circumferential surface of a hole penetrating the plate-like body 65, and a pair of lower monitor fittings 62B disposed at the lower corner portions of the back surface of the display unit 61 and each having a first long hole 67 formed in the plate-like body 65 so as to follow the lateral direction (the direction of the arrow A-B) of the display unit 61. Further, a distance from the shaft center of the threaded hole 66 to the back surface 61' and a distance from the center in the width direction of the first long hole 67 to the back surface 61' are set to be equal to each other.

Further, a plurality of brackets 71 (the second supporting members) which are each connected to the above-mentioned monitor fitting 62 are fixed to a wall 70 (the mounting pedestal), on which the display unit 61 is mounted. The bracket 71 is formed by an L-shaped fitting, similarly to the monitor fitting 62, and a plate-like body 72 on one side constituting the L-shaped fitting is fixed to the wall 70 by an arbitrary method such as using a bolt (not shown) or the like, and a plate-like body 74 (the fixing-side supporting plate) on the other side constituting the L-shaped fitting is disposed so as to protrude from the wall 70 and form a right angle with the wall 70. Specifically, the plate-like body 74 of the bracket 71 is provided at a position corresponding to the plate-like body 65 of the monitor fitting 62 and also formed to protrude toward the back surface 61' of the display unit 61.

Further, a pin member 75 of a multistage cylindrical shape which is engaged with the plate-like body 65 of the monitor fitting 62 and extends so as to follow the lengthwise direction (the direction of the arrow C-D) of the display unit 61 is provided in an upright manner at the plate-like body 74 of the bracket 71. Further, in the plate-like body 74, a second long hole 80 is formed so as to follow the lateral direction.

In the pin member 75, an upper portion in the longitudinal direction (that is, the above-mentioned lengthwise direction) thereof is set to have a diameter slightly smaller than the width dimension M of the first long hole 67 and also inserted into the first long hole 67, and a lower portion in the longitudinal direction thereof is set to have a diameter slightly smaller than the width dimension M of the second long hole 80 and also inserted into the second long hole 80. Due to this configuration, the pin member 75, the first long hole 67 of the plate-like body 65, and the second long hole 80 of the plate-like body 74 are made to be mutually movable in the lateral direction.

Further, in the upper end face of the pin member 75, a hole portion 81 is formed into which a tool such as a hexagonal wrench is inserted and which is for rotating the pin member 75 around the axis thereof by the tool. Further, a threaded portion 76 which is made by performing a male screw threading is formed at least between the upper portion and the lower portion in the outer circumferential surface of the pin member 75, and the threaded portion 76 is thread-engaged with the threaded hole 66 of the upper monitor fitting 62A. Further, the pin member 75 is engaged with the threaded hole 66 in this manner, whereby the plate-like body 74 of the bracket 71, at which the pin member 75 is provided in an upright manner, supports the plate-like body 65 of the upper monitor fitting 62A.

Further, in a state where the pin member 75 is engaged with the threaded hole 66 and the first long hole 67 in this manner, the back surfaces 61' and 61' of the display units 61*a* and 61*b* are set to be flush with each other. Thus, since the back surfaces 61' and 61' are made to be flush with each other in this manner, the respective display screens facing the opposite side to the back surfaces 61' in the display units 61*a* and 61*b* are also set to be flush with each other. Further, a flange portion 77 set to have a diameter larger than the width dimension M of the second long hole 80 is formed between the threaded portion 76 and the lower portion in the pin member 75.

Further, on the upper surface of the flange portion 77 of the pin member 75, a stopper 78 is disposed. The stopper 78 is fixed onto the plate-like body 74 by a screw 79. Due to this configuration, breaking-out or the like of the pin member 75 from the second long hole 80 of the plate-like body 74 is prevented, so that the display unit 61 can be fixed to and held on the wall 70 and problems in which the display unit 61 drops out of the wall 70 can be prevented. Further, with the stopper 78 disposed in this manner, movement in the lateral direction of the pin member 75 with respect to the bracket 71 is restricted.

In addition, in the illustrated example, the bracket 71 is constituted by a bracket 71A having the above-described configuration and a bracket 71B disposed so as to correspond only to the lower monitor fitting 62B of the display unit 61*a* which is disposed at the lower side among the display units 61. Further, the pin member 75 is constituted by a pin member 75A which is disposed at the bracket 71A and has the above-described configuration, and a cylindrical pin member 75B which is disposed at the bracket 71B and does not have the threaded portion 76, the flange portion 77, and the hole portion 81.

Specifically, the bracket 71B has the pin member 75B integrally provided in an upright manner at the plate-like body 74 thereof, instead of forming the above-mentioned second long hole 80. Further, the outer diameter of the pin member 75B is set to have a diameter slightly smaller than the width dimension M of the first long hole 67 of the lower monitor fitting 62B, so that the pin member 75B can be inserted into the first long hole 67.

As described in detail above, in the multi-screen display unit shown in this embodiment, since the pin member 75 of the bracket 71 is thread-engaged with the threaded hole 66 of the upper monitor fitting 62A, movement in the lateral direction of the pin member 75 with respect to the upper monitor fitting 62A is restricted. Further, since the upper portion in the longitudinal direction of the pin member 75 is inserted into the first long hole 67 of the lower monitor fitting 62B in the display unit 61*b* and the lower portion in the longitudinal direction is inserted into the second long hole 80 of the plate-like body 74 in the bracket 71, movement in the lateral direction of the pin member 75 with respect to the lower monitor fitting 62B and the bracket 71 is allowed. Due to this configuration, relative movement in the lateral direction of the display units 61*a* and 61*b* contiguous to each other in an up-and-down direction or of the display units 61*a* and 61*b* and the wall 70 becomes possible, so that it is possible to easily adjust misalignment in the lateral direction of the display unit 61. Further, after adjustment, by fixing the stopper 78, as described above, the above-mentioned relative movement is restricted.

Further, since the pin member 75 is thread-engaged with the threaded hole 66 of the upper monitor fitting 62A, by rotating the pin member 75 around the axis thereof, the upper monitor fitting 62A can be moved in the lengthwise direction with respect to the plate-like body 74 with the pin member 75 provided in an upright manner. Therefore, movement in the lengthwise direction of the display unit 61 with respect to the wall 70 is possible, so that misalignment in the lengthwise direction of the display unit 61 can also be easily adjusted.

In this manner, according to the fixing structure and the fixing method of the multi-screen display unit related to this embodiment, it is possible to easily perform the positioning of the display unit 61 in the lateral and lengthwise directions thereof.

In addition, in the illustrated example, a single pin member 75 is disposed at the bracket 71. However, a pair of pin members 75 may also be disposed at the bracket 71 in the same manner as in the embodiments described above. Thus, the display unit 61 may also be provided in a plurality in the lateral direction.

REFERENCE SYMBOLS

1, 61: display unit
1', 61': back surface
2, 62: monitor fitting (first supporting member)
2A, 62A: upper monitor fitting (first supporting member)
2B, 62B: lower monitor fitting (first supporting member)
4, 64: screw
5, 65: plate-like body (display-side supporting plate)
6: long hole
10: frame (mounting pedestal)
11, 71: bracket (second supporting member)
14, 74: plate-like body (fixing-side supporting plate)
15, 75: pin member
16: base end portion
17: support pin
17A: intermediate portion of support pin
30: screw
31: screw
40: L-shaped fitting
66: threaded hole
67: first long hole
70: wall (mounting pedestal)
76: threaded portion
80: second long hole

The invention claimed is:

1. A fixing structure for a multi-screen display unit which forms a large screen by contiguously disposing a plurality of display units with respect to a mounting pedestal by making a first supporting member provided on a back surface of a display unit be engaged with a second supporting member provided at the mounting pedestal, wherein:

the first supporting member includes a monitor fitting which has a display-side supporting plate provided so as to protrude from the back surface of the display unit and is disposed at a corner portion of the back surface of the display unit;

the second supporting member includes a fixing-side supporting plate which is provided at a position corresponding to the display-side supporting plate to protrude toward the back surface of the display unit and supports the display-side supporting plate;

a pin member is provided in an upright manner at the fixing-side supporting plate so as to be engaged with the display-side supporting plate and follow a lengthwise direction of the display unit; and the display-side supporting plate and the fixing-side supporting plate relatively move so as to follow a lateral direction of the display unit.

2. The fixing structure for the multi-screen display unit according to claim 1, wherein:

the monitor fitting includes a pair of upper monitor fittings which is disposed at upper corner portions of the back surface of the display unit and each has a threaded hole formed in the display-side supporting plate, and a pair of lower monitor fittings which is disposed at lower corner portions of the back surface of the display unit and each has a first long hole formed in the display-side supporting plate so as to follow the lateral direction;

the fixing-side supporting plate has a second long hole formed so as to follow the lateral direction; and in the pin member, an upper portion in a longitudinal direction thereof is inserted into the first long hole, a lower portion in the longitudinal direction thereof is inserted into the second long hole, and a threaded portion formed at least between the upper portion and the lower portion is thread-engaged with the threaded hole.

3. The fixing structure for the multi-screen display unit according to claim 1, wherein:

the monitor fitting includes a pair of upper monitor fittings which is disposed at upper corner portions of the back surface of the display unit, and a pair of lower monitor fittings which is disposed at lower corner portions of the back surface of the display unit;

the display-side supporting plate has a long hole formed so as to follow the lateral direction;

the pin member is inserted into the long hole;

the pin member has a large-diameter base end portion provided on the fixing-side supporting plate, and a small-diameter support pin provided in an upright manner in the lengthwise direction on the base end portion;

a long hole of the upper monitor fitting has a width dimension set so as to be engaged with the base end portion of the pin member, and a long hole of the lower monitor fitting has a width dimension set so as to be engaged with the support pin of the pin member; and in a case where the first supporting member is engaged with the second supporting member, the long hole of the upper monitor fitting is engaged with the base end portion of the pin member, a display-side supporting plate of the upper monitor fitting is supported on a fixing-side supporting plate of the second supporting member, and the long hole of the lower monitor fitting is disposed at an intermediate portion in the longitudinal direction of a support pin of the pin member.

4. The fixing structure for the multi-screen display unit according to claim 3, wherein:

the pin members of the second supporting member include a pair of large-diameter base end portions provided being spaced to each other in the lateral direction on the fixing-side supporting plate, and small-diameter support pins each provided in an upright manner in the lengthwise direction on each of the base end portions; and in a case where at least two display units have been disposed contiguously in the lateral direction, the pin member on one side of the second supporting member is inserted into the long hole of the first supporting member provided at the display unit on one side and the pin member on the other side of the second supporting member is inserted into the long hole of the first supporting member provided at the display unit on the other side.

5. The fixing structure for the multi-screen display unit according to claim 4, wherein in the display-side supporting plate of the first supporting member and the fixing-side supporting plate of the second supporting member, a screw which fastens the display-side supporting plate and the fixing-side supporting plate to each other in a state where the pin member has been inserted into the long hole formed in the display-side supporting plate of the first supporting member is provided.

6. The fixing structure for the multi-screen display unit according to claim 4, wherein:

the first supporting member comprises an L-shaped fitting; and a plate body on one side of the L-shaped fitting constitutes the display-side supporting plate of the upper monitor fitting having a large-diameter long hole with a width dimension set so as to be engaged with the base end portion of the pin member, and a plate-like body on the other side of the L-shaped fitting constitutes the display-side supporting plate of the lower monitor fitting having a small-diameter long hole with a width dimension set so as to be engaged with the support pin of the pin member.

7. The fixing structure for the multi-screen display unit according to claim 3, wherein in the display-side supporting plate of the first supporting member and the fixing-side supporting plate of the second supporting member, a screw which fastens the display-side supporting plate and the fixing-side supporting plate to each other in a state where the pin member has been inserted into the long hole formed in the display-side supporting plate of the first supporting member is provided.

8. The fixing structure for the multi-screen display unit according to claim 7, wherein:

the first supporting member comprises an L-shaped fitting; and a plate body on one side of the L-shaped fitting constitutes the display-side supporting plate of the upper monitor fitting having a large-diameter long hole with a width dimension set so as to be engaged with the base end portion of the pin member, and a plate-like body on the other side of the L-shaped fitting constitutes the display-side supporting plate of the lower monitor fitting having a small-diameter long hole with a width dimension set so as to be engaged with the support pin of the pin member.

9. The fixing structure for the multi-screen display unit according to claim 3, wherein:

the first supporting member comprises an L-shaped fitting; and a plate body on one side of the L-shaped fitting constitutes the display-side supporting plate of the upper monitor fitting having a large-diameter long hole with a width dimension set so as to be engaged with the base end portion of the pin member, and a plate body on the other side of the L-shaped fitting constitutes the display-side supporting plate of the lower monitor fitting having a small-diameter long hole with a width dimension set so as to be engaged with the support pin of the pin member.

10. A fixing method for a multi-screen display unit which forms a large screen by contiguously disposing a plurality of display units with respect to a mounting pedestal, the method comprising:

disposing monitor fittings each having a display-side supporting plate provided so as to protrude from a back surface of a display unit, at corner portions of the back surface of the display unit; and adjusting misalignment in a lateral direction of the display unit by adjusting a position of the display-side supporting plate with respect to a fixing-side supporting plate along the lateral direction of the display unit in a state where a pin member provided at the mounting pedestal through the fixing-side supporting plate is engaged with the display-side supporting plate.

11. The fixing method for the multi-screen display unit according to claim 10, further comprising:

thread-engaging the pin member with a threaded hole of the display-side supporting plate of each of upper monitor fittings disposed at upper corner portions of the back surface of the display unit among the monitor fittings, and inserting the pin member into a first long hole formed so as to follow the lateral direction in the display-side supporting plate of each of lower monitor fittings disposed at lower corner portions of the back surface of the display unit among the monitor fittings, and inserting the pin member into a second long hole formed in the fixing-side supporting plate so as to follow the lateral direction;

adjusting misalignment in the lateral direction of the display unit by relatively moving the upper monitor fitting, the lower monitor fitting, and the fixing-side supporting plate with respect to one another in the lateral direction; and adjusting misalignment in the lengthwise direction of the display unit by adjusting the thread-engagement state of the pin member and the threaded hole.

12. The fixing method for the multi-screen display unit according to claim 11, further comprising by thread-engaging a screw with the fixing-side supporting plate fixed to the mounting pedestal and the display-side supporting plate of the upper monitor fitting supported by the fixing-side supporting plate, connecting the fixing-side supporting plate and the display-side supporting plate to each other.

13. The fixing method for the multi-screen display unit according to claim 12, further comprising:

disposing a pair of pin members adjacent to each other in the lateral direction at the mounting pedestal of a place where at least two display units are disposed contiguously in the lateral direction; and inserting the pin member on one side into a long hole of the monitor fitting provided at the display unit on one side, and inserting the pin member on the other side into a long hole of the monitor fitting provided at the display unit on the other side.

14. The fixing method for the multi-screen display unit according to claim 10, wherein:

forming a long hole in the display-side supporting plate so as to follow the lateral direction; and adjusting misalignment in the lateral direction of the display unit by inserting the pin member into the long hole and adjusting the position of the pin member with respect to the long hole along the length direction of the long hole.

15. The fixing method for the multi-screen display unit according to claim 14, further comprising:

providing the monitor fitting which includes a pair of upper monitor fittings disposed at upper corner portions of the back surface of the display unit, and a pair of lower monitor fittings disposed at lower corner portions of the back surface of the display unit; and supporting a display-side supporting plate of the upper monitor fitting by the fixing-side supporting plate fixed to the mounting pedestal, in a state where the pin member provided at the mounting pedestal through the fixing-side supporting plate has been inserted into long holes of the upper and lower monitor fittings.

16. The fixing method for the multi-screen display unit according to claim 15, further comprising by thread-engaging a screw with the fixing-side supporting plate fixed to the mounting pedestal and the display-side supporting plate of the upper monitor fitting supported by the fixing-side supporting plate, connecting the fixing-side supporting plate and the display-side supporting plate to each other.

17. The fixing method for the multi-screen display unit according to claim 15, further comprising:

disposing a pair of pin members adjacent to each other in the lateral direction at the mounting pedestal of a place where at least two display units are disposed contiguously in the lateral direction; and inserting the pin member on one side into a long hole of the monitor fitting provided at the display unit on one side, and inserting the pin member on the other side into a long hole of the monitor fitting provided at the display unit on the other side.

18. The fixing method for the multi-screen display unit according to claim 14, further comprising:

disposing a pair of pin members adjacent to each other in the lateral direction at the mounting pedestal of a place where at least two display units are disposed contiguously in the lateral direction; and inserting a pin member on one side into a long hole of the monitor fitting provided at the display unit on one side, and a pin member on an other side is inserted into a long hole of the monitor fitting provided at the display unit on the other side.

19. The fixing method for the multi-screen display unit according to claim 18, further comprising:

forming a supporting member by adjacently disposing a pair of pin members which is inserted into the long hole of the monitor fitting; and disposing the supporting member in a plurality to correspond to an installation interval of the long holes of the monitor fittings disposed along the lateral direction of the display unit.

* * * * *